United States Patent [19]

Hirmann

[11] 3,973,471

[45] Aug. 10, 1976

[54] MOTORS

[75] Inventor: Georg Hirmann, Zurich, Switzerland

[73] Assignee: Inventa AG fur Forschung und Patentverwertung Zurich, Zurich, Switzerland

[22] Filed: July 14, 1975

[21] Appl. No.: 595,699

Related U.S. Application Data

[63] Continuation of Ser. No. 400,565, Sept. 25, 1973, abandoned.

[30] Foreign Application Priority Data

Sept. 27, 1972 Switzerland ..... 14147/72

[52] U.S. Cl. ..... 91/472; 91/497; 92/12.2; 92/71; 92/92; 91/180

[51] Int. Cl.[2] ..... F01B 13/04

[58] Field of Search ..... 91/180, 472, 499, 497; 92/64, 72, 92, 121, 71, 12.2, 91

[56] References Cited

UNITED STATES PATENTS

| | | | |
|---|---|---|---|
| 1,347,512 | 7/1920 | Kirby | 91/499 X |
| 2,346,236 | 4/1944 | Rose | 91/472 X |
| 2,392,279 | 1/1946 | Woods | 91/180 X |
| 3,014,348 | 12/1961 | Mauch | 91/472 X |
| 3,232,318 | 2/1966 | Mercier | 92/92 X |
| 3,523,488 | 8/1970 | Robinson | 91/180 |
| 3,554,090 | 1/1971 | Wallace | 92/72 X |
| 3,621,762 | 11/1971 | Yo Ikebe | 91/180 X |

FOREIGN PATENTS OR APPLICATIONS

| | | |
|---|---|---|
| 1,453,668 | 6/1969 | Germany |

*Primary Examiner*—Martin P. Schwadron
*Assistant Examiner*—Abraham Hershkovitz
*Attorney, Agent, or Firm*—Finnegan, Henderson, Farabow & Garrett

[57] ABSTRACT

Hydraulic and pneumatic motors having expansion chambers arranged between two supporting means, at least one of which is rotatable, said chambers formed at least in part of material that is elastically deformable by the pressure medium used, are provided. The invention also provides a control system for introducing the pressure medium into the chambers sequentially and expelling it sequentially after each chamber has attained maximum volume.

8 Claims, 7 Drawing Figures

MOTORS

This is a continuation of application Ser. No. 400,565, filed Sept. 25, 1973, now abandoned.

This invention relates to devices for generating motion by means of a liquid or gaseous pressure medium. More particularly, the invention relates to hydraulic and pneumatic motors in which expansion chambers, formed at least in part of material that is elastically deformable by the pressure medium used, are arranged between two supporting means fixed on axes that are inclined toward each other. The invention also provides a control system for controlling the chambers in such a way that the pressure medium is introduced into them according to the sequence in which they function and, after the maximum volume of each chamber has been respectively achieved, is expelled.

BACKGROUND OF THE INVENTION

Numerous hydraulically or pneumatically energized driving motors which convert static energy introduced by a pressure medium into rotary motion by means of axial, radial or rotary pistons are known. All the known drives have sliding elements near the boundaries of the expansion chambers. Unfortunately, such elements ordinarily require that the pressure medium have lubricating capability or necessitate separate lubrication.

Technical expense involved in the production of existing drives is relatively high. The great majority of the known systems is not practicable for disk connected air and, in general, low pressure energizing for reasons of both construction and expense. In the case of rotary piston (cell) motors generally used for compressed air drive, the efficiency and force are slight due to high friction loss and considerable loss from leakage. They are not usable for low numbers of revolutions.

Motors comprising expansion chambers which are supported on supporting surfaces have already been proposed but not placed on the market. Depending upon the type of construction, significant friction loss occurs in drive as a consequence of the relative movement of the chamber surface areas, especially the border sections. Those motors have the further disadvantage that tensile stress, with peaks of stress in the border areas of the chambers, also appears and results in significantly shortening the length of serviceability of such expansion chambers.

SUMMARY OF THE INVENTION

The present invention avoids the disadvantages of the previously proposed motors in that the expansion chambers of the motors herein are constructed with at least one section of their edges as exposed, freely deformable pressure cells. The motors of this invention can be produced at low cost. Moreover, they are characterized by very high volumetric efficiency and extremely low friction loss.

In general, the present invention contemplates a motor actuated by a fluid pressure medium comprising two support means fixed on axes inclined relative to each other, at least one of said axes being rotatable, and a plurality of freely distortable pressure chambers arranged between said two support means, each of which chambers is constructed at least in part of material that is elastically deformable by said fluid pressure medium. In accordance with the invention, there is further provided pressure control means for admitting the fluid pressure medium into each pressure chamber sequentially and expelling said fluid pressure medium from each pressure chamber after the maximum volume of said chamber has been attained. In operation, motors of the present invention convert the static energy of the fluid pressure medium introduced into each pressure chamber into mechanical rotational energy by the sequential expansion and compression of freely distortable pressure chambers and the concomitant rotation of at least one of the support means fixed on its axis, that axis being connected to a part to be driven.

The invention now will be described with reference to preferred embodiments illustrated in the accompanying drawings which are incorporated in and constitute a part of this specification.

DETAILED DESCRIPTION OF THE INVENTION

Reference will now be made in detail to the preferred embodiments of the present invention, examples of which are illustrated in the accompanying drawings.

Figure 1:
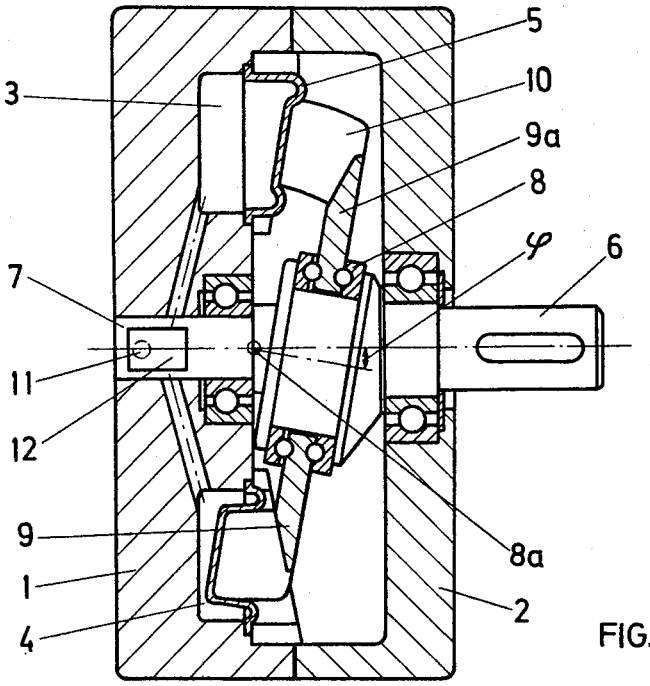
FIG. 1 is a longitudinal cross section through a motor with partly elastic expansion chambers between fixed and tumbling support disks.

FIG. 1 shows an axial cross section through a pressure gas motor with two chamber sections 1 and 2 bolted to one another. In the chamber section 1 there are, in general, at least three, and in the working model depicted, an even number, concentrically arranged chambers 3 and 4. Each chamber 3 and 4 is closed by a membrane 5. The rotating part of the motor includes a driving shaft 6, which is arranged inside both chamber sections 1 and 2. The inner end of the shaft 6 is constructed as a rotary slide valve 7. In the middle section of the shaft 6 and inclined toward the shaft 6 at the angle $\phi$ is arranged a pivot 8 whose axis intersects the axis of the shaft 6 at point 8*a*. In the pivot 8 a tumbling support disk 9 with displacement cams 10 is arranged in such a way that it can rotate. The chamber section 1 has a connection for pressure gas on one side and a connection for exhaust gas on the opposite side. One connection 11 is shown in FIG. 1.

In order to set the motor in operation, pressure gas is introduced through connection 11. Recesses 12 located opposite each other in the rotary slide valve 7, which serves as a steering mechanism, connect the chamber 3 found on the rising portion 9*a* of the tumbling support disk 9 with the pressure connection 11 and the opposite chamber 4 with the backflow connection or the exhaust. The chamber 3 expands under pressure causing the disk 9 to tumble and thereby displacing the shaft 6 in rotation. Each chamber or cell 3 operates freely with the displacement cam 10 so that the membrane section 5 of the cell 3, corresponding to the border area of the cam 10, can unwind or press around the edge of the cam in such a way that the movement of the chamber border area is free of additional stress and virtually frictionless. The amount of torque depends upon the excess pressure of the gas in each chamber 3, the angle of inclination of the tumbling disk, the total active membrane area of each chamber under pressure, as well as the effective radius of the active surface of each membrane 5.

The motor's direction of rotation can be changed by reversing the pressure or reversing the back-flow pipeline. The rate of rotation is regulated, in the case of hydraulically driven motors, by the rate of flow. In the case of pneumatic energizing, the rate of rotation is pressure and load controlled. However, exact regulation of the rate of rotation can be effected even in the case of a variable load by means of a regulating mechanism affecting the pressure or amount of fluid.

Figure 2:
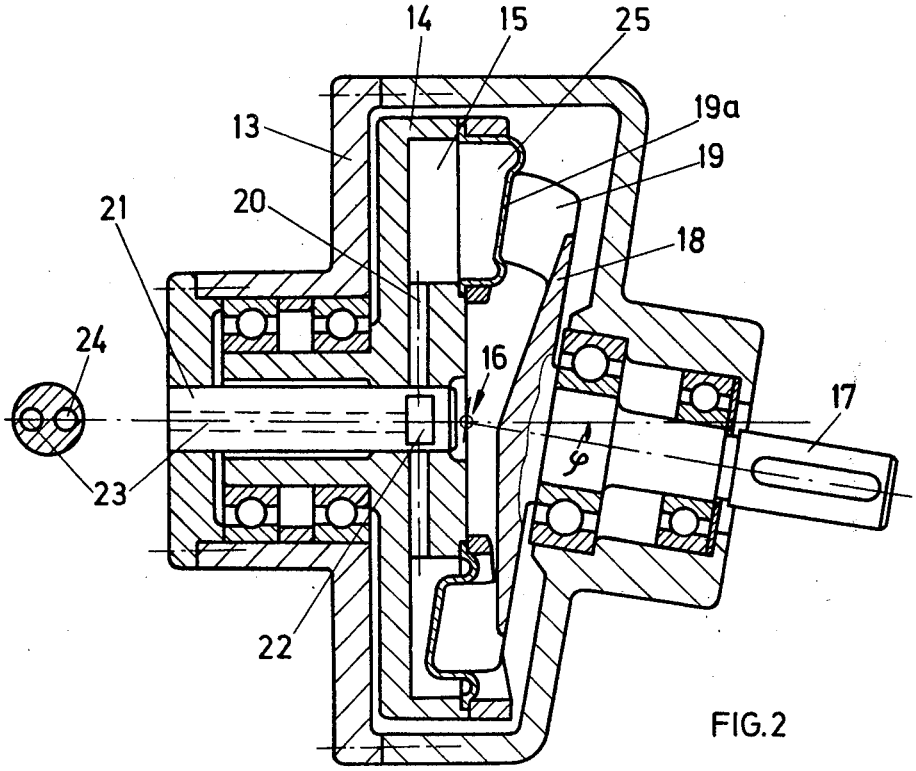
FIG. 2 is a longitudinal cross section through a motor with partly elastic expansion chambers between two rotating support disks inclined toward each other.

FIG. 2 shows a motor with rotating pressure and expansion chambers. It includes a rotating support disk 14, located in a casing 13, with at least three chambers 15, a driving shaft 17 inclined at an angle $\phi$ to the rotating axis of the supporting disk 14, and a supporting disk 18 with displacement cams 19 connected to the shaft 17. The active surfaces 19*a* of the cams 19 are perpendicular to the axis of the supporting disk 18. The axes of the shaft 17 and the supporting disk 14 intersect at a point 16. As in the FIG. 1 embodiment, each chamber or cell 15 operates freely with a displacement cam 19, so that a rotational motion in the direction discussed results. To control the chamber 15 through connecting channels 20 there is a distributing slide valve servo-piston 21 attached to a rotating installation in the casing 13, with passages opposite it that are connected to the pressure or back-flow pipe (not shown) by means of parallel borings 23 and 24 in the distributing slide valve servo-piston 21. Control of the chamber 15 closed off by membrane 25 is effected as in the case of the operation of the FIG. 1 embodiment. The supporting disks 14 and 18 rotate, in the case of this motor, synchronously with the driving shaft 17. By introducing a pressure medium into the chamber 15, the membrane 25 transmits a force operating perpendicularly to the contact surface of the cam 19, which depends upon the size of the angle $\phi$. Upon inflation of the chamber 15, there is produced a wedging effect between the inclined surfaces of the disks 14 and 18 which is manifested in a torque and effects the rotation of the two disks 14 and 18. The supporting disk 14 is rotated synchronously by the force-locking and, in part, form-locking connection between the cam 19 and the membrane 25. This type of construction offers the additional possibility, beyond those offered by that illustrated in FIG. 1, of changing the direction of rotation of the distributing valve servo-piston 180° in the casing and the rate of rotation of the shaft 17 by changing the relative angle of inclination $\phi$ or rotating the distributing slide valve servo-piston less than 90°. Upon a rotation of 90°, the shaft 17 stands still since inflow and outflow is taking place in the central position of the supporting disk 9, in which the force vector intersects the rotating axis of the shaft 17 and therefore can create no momentum.

Figure 3:
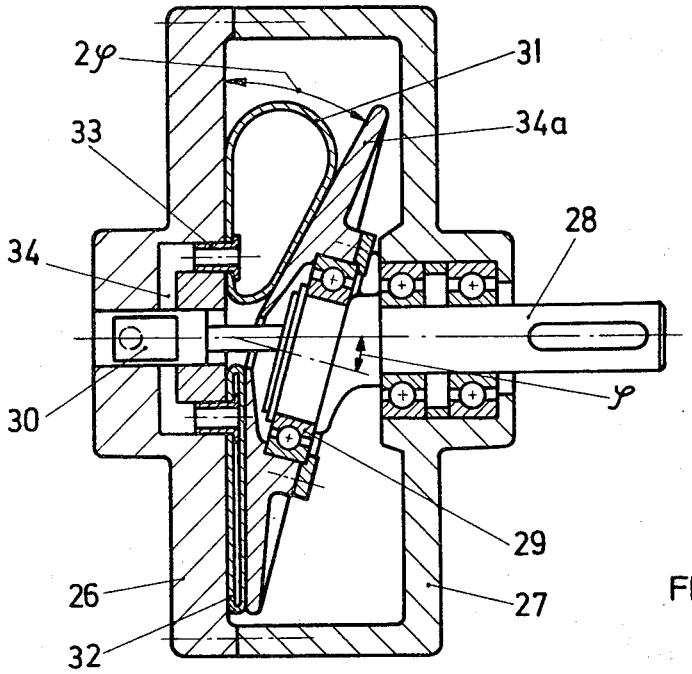
FIG. 3 is a longitudinal cross section through a motor with expansion chamber hulls produced entirely of flexible materials and arranged between fixed and tumbling support disks.

FIG. 3 shows a motor with casing 26 and 27, a driving shaft 28 and a sloping pivot 29. A distributing slide valve servo-piston 30 is connected to the driving shaft 28. Sacks 31 and 32 of rubber or flexible plastic materials are firmly attached to the casing by means of collared sleeves 33 and connected to the distributing slide valve servo-piston 30 through individual, radial channels. In this embodiment, the surface area of the support means over which each pressure chamber is connected thereto is relatively small compared to the total surface area of the support means. Control of this motor is similar to that of the FIG. 1 motor and in part identical, with the difference that in this case the expansion chambers are formed by completely flexible, sack-shaped bodies, which inflate or compress depending upon the position of the tumbling support disk 34*a*. In this case as well, the casings 26 and 27 and the support or tumbler disk 34*a* stand still. The sacks 31 that are in an inflated condition produce a force in the direction of the axis of the disk 34*a*, which operates through a pivot 29 on the tumbler body of the shaft 28 and produces a torque that drives the shaft 28. The rotating shaft 28 controls, through the distributing slide valve servo-piston 30 that is also rotating, the flow of the pressure medium into and out of the sacks 31 and 32. The angle of inclination of the tumbler axis relative to the shaft axis is $\phi$ and the governing angle of inclination of the force vector is $2\phi$.

In the FIG. 3 embodiment, each sack or cell 31 operates freely with the support surfaces of the casing 26 and the disk 34*a* in such a way that the sacks or cells 31 and 32 have free border or outer peripheral areas, and when operating, they effect a rotational motion causing minimal wear and tear.

Figure 4:
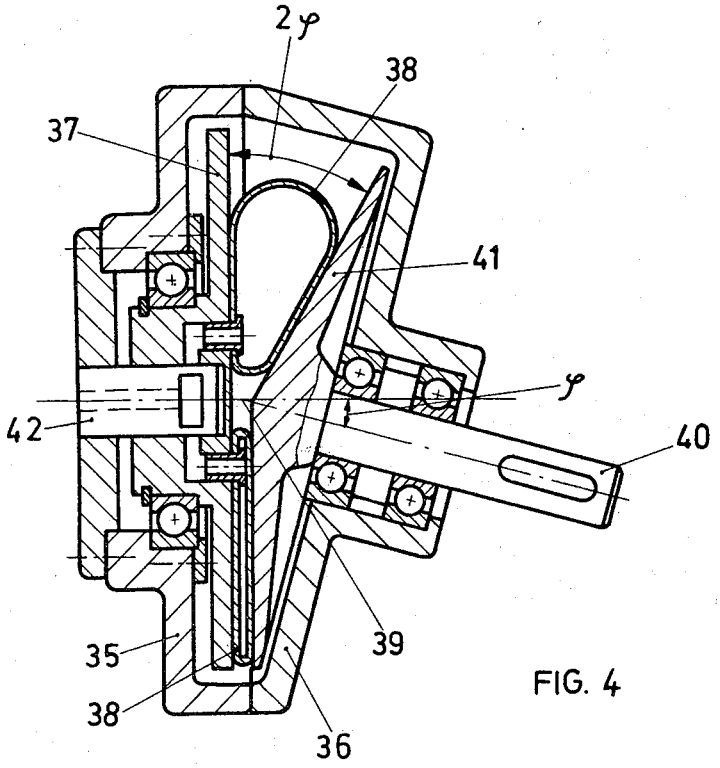
FIG. 4 is a longitudinal cross section through an engine with expansion chamber hulls made entirely of flexible material and arranged between two rotating support disks inclined toward each other.

FIG. 4 represents a motor of a type of construction comparable to that depicted in FIG. 2, i.e., having two rotating support disks 37 and 41 whose rotational axes are inclined at an angle $\phi$ relative to each other, one of these supports 37 having pressure chambers attached thereto, and the other 41 being connected to the drive output shaft 40. The motor illustrated in FIG. 4 alters the construction of the type of motor in FIG. 2 by one particular feature that is depicted in FIG. 3, i.e., freely distortable pressure chambers 38, which are constructed of material that is elastically deformable by the fluid pressure medium, are firmly attached by means of collared sleeves to support disk 37 in communication with the channels for conveying the fluid pressure medium and which completely inflate or compress depending upon the position of the tumbling support disk 41. As in the FIG. 3 embodiment, each sack or cell 38 operates freely with the supporting disk surfaces of 37 and 41 in such a way that the sacks or cells 38 have free border areas and, when operating, they effect a rotational motion causing minimal wear and tear. The other operational aspects of the FIG. 4 motor are similar to those of the FIG. 2 motor. Control is once again effected by means of a rotary slide valve 42 secured rotatably in a casing section 35 in a manner similar to that disclosed in connection with the motor shown in FIG. 2.

Figure 5:
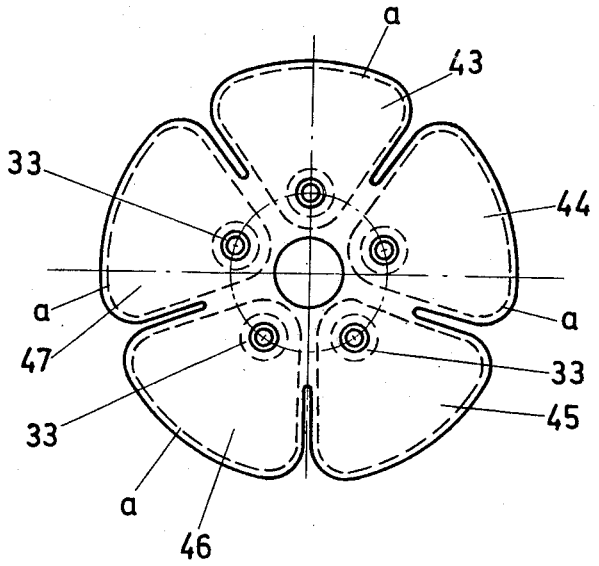
FIG. 5 is a multi-chamber body of flexible foils from a top view.

FIG. 5 shows a multi-lobed, rosette-shaped multiple expansion device suitable for use in the motors of FIGS. 3 or 4 and consisting of five individual chambers 43, 44, 45, 46 and 47. The chamber walls are indicated by the dotted line *a*. In this case, operation is a matter of combining sacks similar to the sacks 31 and 32 in FIG. 3. The expansion device is produced from two sheets of flexible material such as plastic. In the center is an opening for the driving shaft, while the compressing tubes 33, as in FIG. 3, are likewise indicated.

It is very important that the cells be separated by radial slits, despite their common middle section, so that the main parts can expand without, as a practical matter, additional tensile stress and friction.

Figure 6:
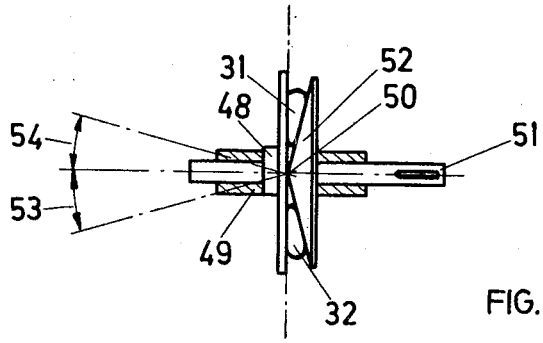
FIG. 6 is a purely schematic representation of a longitudinal cross section through a motor with inclinable support disks.

FIG. 6 is a schematic representation of the support disk of a motor of the type of construction shown in FIG. 4. A support disk 48 is located in a pivot 49 and can be revolved around the point 50. Further, there is a conical support disk 52 connected to a driving shaft 51. There are also two sacks 31 and 32. FIG. 6 shows the support disks 48 and 52 in neutral position (angle of inclination of the disk axis = zero) in which no rotation takes place. If, however, the supporting disk 48 is inclined in direction 53, the motor runs in one direction of rotation, and upon inclination in direction 54, it runs in the opposite direction. The rate of rotation of the shaft can therefore be decreased and the torque increased by changing the inclination of the rotating shaft, and the size of the angle of the inclination in the case of constant feeding energy, without reversing the pressure and back-flow connections of the medium being used. Likewise, the rate of flow and the operating pressure can also be regulated.

The motors of the types of construction shown in FIGS. 1 and 3 can be used as printing drum motors if the distributing slide valve servo-piston in each case is rotated by an exterior control organ, whereby the driving shaft undergoes the same rate of rotation but develops a much greater torque.

Figure 7:
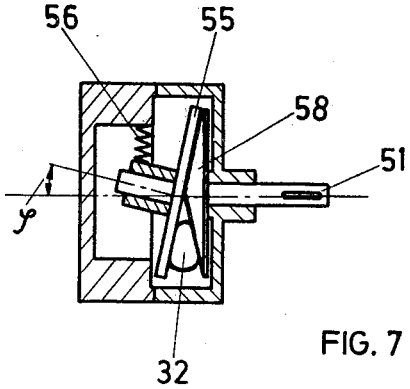
FIG. 7 is a purely schematic representation of a longitudinal cross section through a motor with a load-controlled and automatic control of the relative inclination of the support disks, where the support disks are rotatable.

FIG. 7 shows in schematic representation a motor similar to that depicted in FIG. 6 with rotating support disks 55 and 58. In this case, however, a revolvable support disk 55 is loaded with a pressure spring 56 which exercises a constant or adjustable force. As the load is increased, the angle of inclination is increased, and likewise, as the load is decreased, the angle is decreased. In this way, an automatic and load-controlled regulation of the amount of torque can be achieved.

All the embodiments of FIGS. 1, 2, 3 and 4 are motors with rotary slide valve controls, and the operational parts and constructions of the chambers and support disks are clear and distinct. Of course, there are several other possibilities for regulating these motors, e.g., by means of a flat slide valve, eccentrically moving slide valve ring, valves with cam regulation or the like.

Furthermore, it is possible to construct motors with multiple expansion chamber planes and to control these by one or more control systems.

The possibilities of utilization of the motors represented herein are appreciable, and the realm of application is expanded considerably by the facts that the cost of manufacture of a comparable electric motor, for example, are not exceeded, that the motor can be used without a reduction gear from "zero" rate or rotation, and further, that the greatest amount of torque can be developed at every rate of rotation.

It will be apparent to those skilled in the art that various modifications and variations could be made in the motors of the present invention without departing from the scope or spirit of the invention.

What is claimed is:

1. A motor actuated by a fluid pressure medium comprising a rotatable output drive shaft, first and second support means having axes relatively inclined at an intersecting angle and movable relative to each other, said first support means having a conical surface facing the second support means, said first support means being connected to the output shaft to cause rotation thereof upon movement of said first support means, a multi-lobed, rosette shaped structure divided into a plurality of independent, freely distortable pressure chambers having freely distortable outer peripheral areas arranged between the first and second support means, means for connecting each lobe of the rosette structure only to said second support means over a relatively small area compared to the total surface area of the second support means, and pressure control means for admitting said fluid pressure medium into each pressure chamber sequentially to cause movement of the first support means and rotation of the output shaft and permitting said fluid pressure medium to be expelled from each pressure chamber after the maximum volume of each chamber has been attained.

2. The motor of claim 1, wherein both support means comprise rotating disks rotatable about their axes, said first support disk being affixed to the output shaft so that the axis of the shaft is also inclined to the axis of the second support disk and wherein said rosette structure rotates simultaneously with both support disks and the output shaft.

3. The motor of claim 1 wherein the means for connecting each lobe of the rosette-shaped structure to said second support means is a collared sleeve locking each pressure chamber in communication with said second support means.

4. The motor of claim 1, wherein said second support means is fixed and the first support means comprises a tumbling support diskconnected through a pivot means to the output shaft whereby tumbling movement of the disk in response to sequential inflation of the pressure chambers causes rotation of the output shaft.

5. The motor of claim 1, wherein said multi-lobed, rosette-shaped structure is made of flexible plastic sheet material.

6. The motor of claim 1, wherein said pressure control means includes a rotary slide valve.

7. The motor of claim 1, further comprising means for regulating the angle of inclination of the axis of the second support means relative to the axis of the first support means connected to said output shaft.

8. The motor of claim 7, wherein said means for regulating the angle of inclination is a spring.

* * * * *